United States Patent [19]

Brewer

[11] Patent Number: 4,506,586

[45] Date of Patent: Mar. 26, 1985

[54] QUICK RELEASE DRUM HEAD RESTRAINT

[76] Inventor: Lewis E. Brewer, 2514 S. 219th St., Seattle, Wash. 98188

[21] Appl. No.: 609,650

[22] Filed: May 14, 1984

[51] Int. Cl.[3] ..... G10D 13/02

[52] U.S. Cl. ..... 84/413

[58] Field of Search ..... 84/411–420

[56] References Cited

U.S. PATENT DOCUMENTS

| | | | |
|---|---|---|---|
| 1,039,834 | 10/1912 | Soistmann | 84/411 R |
| 3,626,801 | 12/1971 | Moore | 84/411 R |
| 4,211,144 | 7/1980 | May | 84/411 A |
| 4,373,419 | 2/1983 | Tuttrup | 84/411 R |

FOREIGN PATENT DOCUMENTS

| | | | |
|---|---|---|---|
| 66830 | 5/1948 | Denmark | 84/413 |
| 16427 | of 1909 | United Kingdom | 84/411 R |
| 2075238 | 11/1981 | United Kingdom | 84/411 R |

*Primary Examiner*—Lawrence R. Franklin

*Attorney, Agent, or Firm*—Banner, Birch, McKie & Beckett

[57] ABSTRACT

What is disclosed is a quick release drum head restraint for a musical drum. The restraint consists of a pendulum unit and a toggle unit which enable the user to quickly remove and replace a drum head without significantly altering the tuning of the drum head. The pendulum unit includes a tension rod fastened at one end to the rim head and at the other end to a cylindrical pendulum which includes a bushing located at its center. The cylindrical pendulum fits inside the toggle unit and the bushing slides on an inclined plane or ramp within the toggle unit. The toggle units swivels or pivots at a pivot point to engage the cylindrical pendulum and enable the bushing to roll along the ramp. Thus, the drum head can be quickly removed by pivoting the toggle unit to release the pendulum unit and the new drum head can be installed by reinserting the pendulum unit in the toggle unit. Replacement of the drum head does not significantly alter the tuning of the drum head.

6 Claims, 12 Drawing Figures

QUICK RELEASE DRUM HEAD RESTRAINT

BACKGROUND OF THE INVENTION

The present invention relates generally to the field of musical drums, and more particularly, is directed to a quick release drum head restraint which enables the drum head to be quickly replaced without significantly altering the tuning of the drum.

A conventional musical drum comprises a cylindrical body having at least one end covered by a drum head. The drum head includes a rim which holds a drum skin in tension over the drum body. The rim is secured to the drum body by a plurality of tension screws which pass through the rim and are received in brackets mounted around the periphery of the drum body. The drum head is tuned to the desired pitch and tone by adjusting each tension screw in its corresponding bracket. Because the adjustment of each screw affects the adjustment of other screws, tuning of the drum head is a trial and error endeavor requiring a considerable amount of time. Thus, when tuning is finally achieved, users are reluctant to remove the drum head to perform routine maintenance or to install a different sounding drum head. When it becomes necessary to remove the drum head, however, each tension screw must be completely unscrewed from its bracket. This is a time consuming task. More importantly, the prior state of tune is lost and the drum head must be completely retuned when it is replaced on the drum body. The considerable amount of time required to retune the drum after replacement of the drum head is a significant disadvantage, especially on those occasions where replacement must be accomplished during the course of a musical performance.

SUMMARY OF THE INVENTION

It is the overall object of the present invention to provide a drum head restraint which returns the drum to its previous pitch and tone after the drum head has been replaced.

It is a specific object of the present invention to provide a drum head restraint which can quickly release and reattach the drum head to the drum body without adversely affecting the tuning of the drum.

It is another specific object of the present invention to provide a quick release drum head restraint which is simple in construction and reliable in operation.

It is a still further specific object of the present invention to provide a quick release drum head restraint which can be readily operated by the user.

The quick release drum head restraint in accordance with the present invention comprises a pendulum unit and a toggle unit which interact to enable the drum user to quickly remove and replace the drum head without significantly altering the tuning of the drum. The pendulum unit includes a tension rod fastened at one end to the drum rim and at the other end to a cylindrical pendulum which includes a bushing located at its center which serves as a guide. The cylindrical pendulum fits inside the toggle unit and the bushing slides on an inclined plane or ramp within the toggle unit. The toggle unit swivels or pivots at a pivot point to engage the cylindrical pendulum and enable the bushing to slide over th ramp. Thus, the drum head can be quickly removed and replaced by simply pivoting the toggle units located around the periphery of the drum rather than removing and replacing a plurality of tension screws as in the conventional drum. A further advantage of the quick release drum head restraint in accordance with the present invention is that the drum head may be removed and replaced without significantly altering the tuning of the drum.

DESCRIPTION OF THE PREFERRED EMBODIMENT

Figure 1:
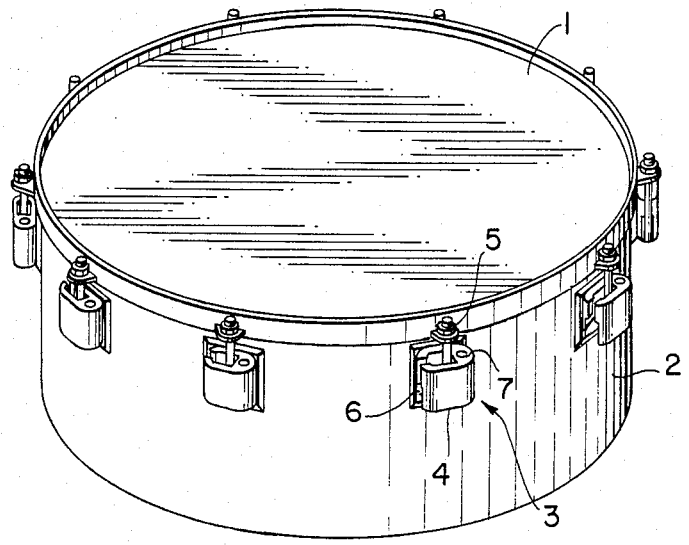
FIG. 1 is a perspective view of a drum having a plurality of quick release drum head restraints in accordance with the present invention.
Figure 3:
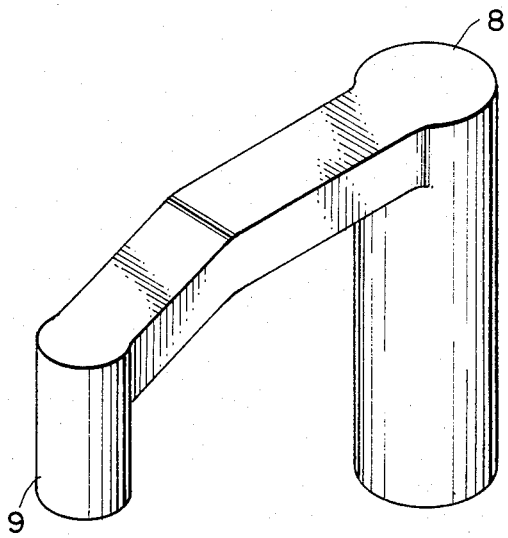
FIG. 3 is a perspective view of the release key used to operate the quick release drum head restraint in accordance with the present invention.

FIG. 1 illustrates a musical drum having drum head 1 mounted on drum body 2. Drum head 1 is held in position on body 2 by a plurality of quick release drum head restraints 3 located around the periphery of the drum head and drum body in accordance with the present invention. Restraint 3 comprise pendulum unit 5 rigidly attached to drum head 1 and toggle unit 4 pivotally attached to bracket 6. Bracket 6 is rigidly attached to drum body 2. Toggle unit 4 includes hole 7 which receives round portion 9 of release key 8 shown in FIG. 3. When it is desired to removed drum head 1 from drum body 2, round portion 9 of release key 8 is inserted in hole 7 and release key 8 is used to pivot toggle unit 4 out of engagement with pendulum unit 5. Each of the plurality of quick release restraints 3 are released accordingly, thus allowing drum head 1 to be removed from body 2. When drum head 1 is replaced on drum body 2, release key 8 is used to pivot toggle unit 4 into engagement with pendulum unit 5.

Figure 4:
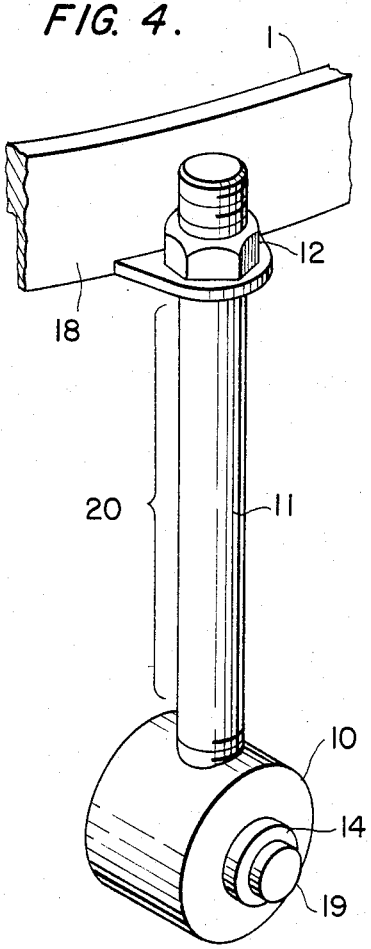
FIG. 4 is a perspective view of the pendulum unit of the quick release drum head restraint in accordance with the present invention.
Figure 7:
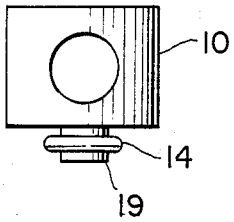
FIG. 7 is a top view of the cylindrical pendulum of the pendulum unit shown in FIG. 4.
Figure 8:
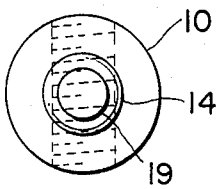
FIG. 8 is a side view of the cylindrical pendulum of the pendulum unit shown in FIG. 4.
Figure 9:
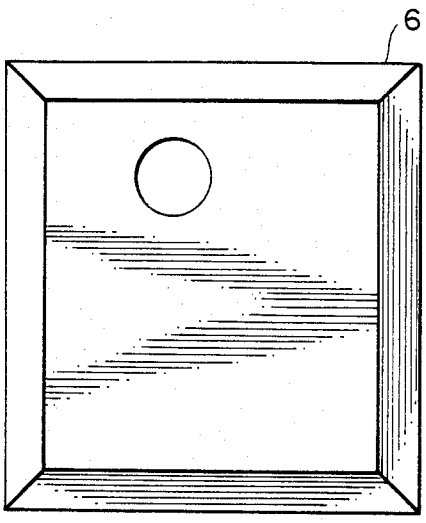
FIG. 9 is a front view of one embodiment of a bracket used to mount the toggle unit shown in FIG. 2 to the body of the drum.
Figure 11:
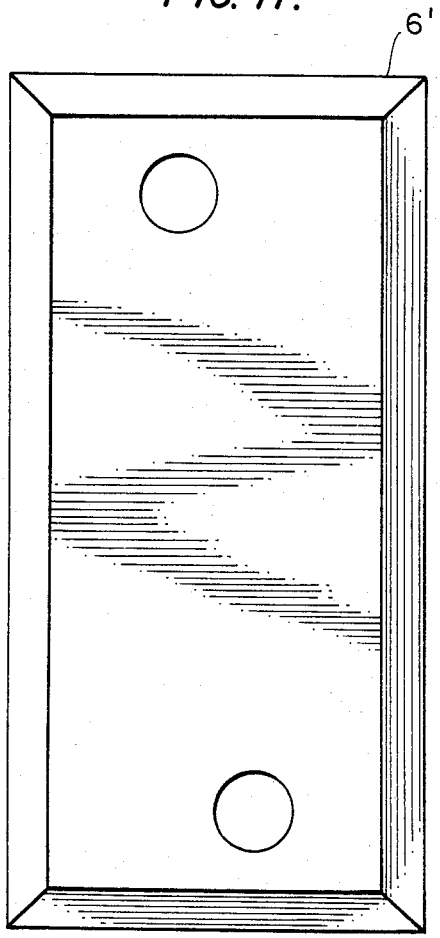
FIG. 11 is a front view of another embodiment of a bracket used to mount the toggle unit shown in FIG. 2 to the body of the drum.

Pendulum unit 5 is shown in more detail in FIGS. 4, 7 and 8. Pendulum unit 5 may be formed of glass-filled nylon or any other material, such as fiber glass for example, which has the requisite strength for the application. As shown, pendulum unit 5 comprises tension rod 11 fastened at one end to rim 18 of drum head 1 by nut 12. Nut 12 is shown as an illustration only and tension rod 11 may be fastened to rim 18 by any other means known in the prior art. The other end of tension rod 11 is threadedly received in cylindrical pendulum 10. Pendulum 10 includes bushing 14 which slides along a ramp formed within toggle unit 4. As shown in FIG. 7, bushing 14 is mounted on stem 19 projecting from pendulum 10.

The drum shown in FIG. 1 is initially tuned by pivoting toggle units 4 into engagement with their respective pendulum units 5. The desired pitch and tone of the drum may then be established by adjusting length 20 of each pendulum unit 5. Length 20 may be adjusted by nut 12 or by increasing or decreasing the depth of engagement of tension rod 11 in pendulum 10.

Figure 2:
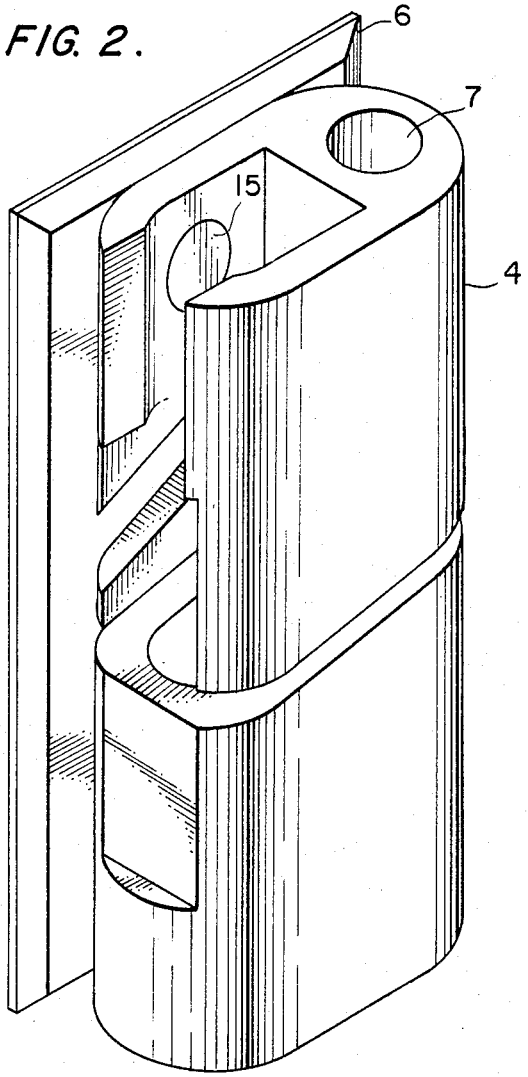
FIG. 2 is a perspective view of the toggle unit of the quick release drum head restraint in accordance with the present invention.
Figure 5:
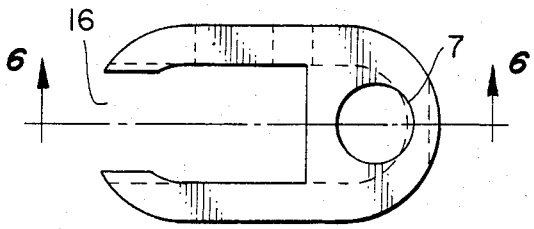
FIG. 5 is a top view of the toggle unit shown in FIG. 2.
Figure 6:
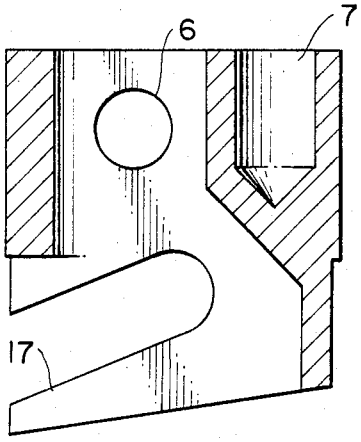
FIG. 6 is a section view of the toggle unit shown in FIG. 5 taken along line 6—6.

Toggle unit 4 may also be formed of glass-filled nylon, fiber glass and other such high strength materials and is shown in more detail in FIGS. 2, 5 and 6. Toggle unit 4 is pivotally attached to bracket 6 by pivot device 15 and includes hole 7 which receives round portion 9 of release key 8. Bracket 6 is rigidly attached to drum body 2. Toggle unit 4 also includes cavity 16 which receives pendulum 10 of pendulum unit 5. Enclosed ramp 17 is formed inside cavity 16 (better shown in FIG. 6) which receives bushing 14 of pendulum 10.

Drum head 1 is secured to drum body 2 by pivoting each toggle unit 4 into engagement with its corresponding pendulum unit 5 with the aid of key 8. As pendulum unit 5 is received in cavity 16 of toggle unit 4, bushing 14 slides along ramp 17 until the pendulum and toggle unit are fully engaged. Drum head 1 may be removed from drum body 2 by pivoting each toggle unit 4 out of engagement with its corresponding pendulum unit 5. Because length 20 of tension rod 11 is not effected by engagement and disengagement of the toggle and pendulum units, the tuning of the drum is not altered when drum head 1 is removed and replaced. Another important feature of the drum head restraint in accordance with the present invention is that it enables the drum head to be removed by simply pivoting the toggle units located around the periphery of the drum rather than by removing a plurality of tension screws as in the conventional drum. Thus, the drum head may be removed and replaced much more quickly.

Figure 10:
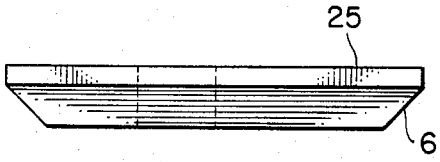
FIG. 10 is a top view of the bracket shown in FIG. 9.
Figure 12:
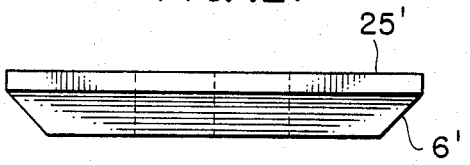
FIG. 12 is a top view of the bracket shown in FIG. 11.

FIGS. 9–12 show two embodiments of bracket 6 used to mount toggle unit 5 to drum body 2. The embodiment shown in FIGS. 9 and 10 may be used with drums having only one drum head, such as the drum shown in FIG. 1. The embodiment shown in FIGS. 11 and 12 may be used with drums having two drum heads, such as a snare drum. Thus, two toggle units may be pivotally mounted on the same bracket 6 to receive corresponding pendulum units attached to respective drum heads. Although back surface 25 and 25′ of brackets 6 and 6′ (which mounts against drum body 2) are shown in FIGS. 10 and 12 as being flat, these surfaces may also be formed in a concave shape to match the outer contour of the drum body.

Obviously, many modifications and variations of the above-described preferred embodiments will become apparent to those skilled in the art from a reading of this disclosure. It should be realized that the invention is not limited to the particular quick release drum head restraint disclosed but is scope is intended to be governed only by the scope of the appended claims.

I claim:

1. In a drum having a drum body and a drum head, said drum head having a rim holding a drum skin in tension over said drum body, a restraining device securing said drum head to said drum body, said restraining device comprising:

a rod attached to said drum head at one end and to a pendulum at the other end, said pendulum having a bushing defining a sliding surface, wherein the length of said rod between said drum head and said pendulum is adjustable to tune said drum; and a toggle unit pivotally attached to said drum body to engage said pendulum, said toggle unit having a cavity for receiving said pendulum, said cavity having a ramp portion which slidably receives said bushing when said pendulum is received in said cavity to secure said drum head to said drum body, wherein the length of said rod between said drum head and said pendulum is not changed when said toggle unit is moved in and out of engagement with said pendulum.

2. The restraining device of claim 1 wherein said said toggle unit further comprises a cavity for receiving handle means for pivoting said toggle unit in and out of engagement with said pendulum.

3. The restraining device of claim 1 wherein said rod is threadedly received in said pendulum to permit said drum to be readily tuned.

4. The restraining device of claim 1 wherein said toggle unit is formed from glass filled nylon.

5. The restraining device of claim 1 wherein said rod and said pendulum are formed from glass filled nylon.

6. The restraining device of claim 1 wherein said device is formed from fiber glass.

* * * * *